US007849803B2

(12) United States Patent
Conley

(10) Patent No.: US 7,849,803 B2
(45) Date of Patent: Dec. 14, 2010

(54) EXPANDABLE TABLE AND CENTER ALIGNMENT ASSEMBLY FOR SUCH AN EXPANDABLE TABLE

(75) Inventor: James R. Conley, Hickory, NC (US)

(73) Assignee: Century Furniture LLC, Hickory, NC (US)

( * ) Notice: Subject to any disclaimer, the term of this patent is extended or adjusted under 35 U.S.C. 154(b) by 450 days.

(21) Appl. No.: 11/892,620

(22) Filed: Aug. 24, 2007

(65) Prior Publication Data

US 2009/0050032 A1 Feb. 26, 2009

(51) Int. Cl.
*A47B 1/00* (2006.01)

(52) U.S. Cl. ..... 108/65; 108/67

(58) Field of Classification Search ..... 108/65, 108/67, 68, 115, 83, 89, 87
See application file for complete search history.

(56) References Cited

U.S. PATENT DOCUMENTS

| | | | | | |
|---|---|---|---|---|---|
| 254,388 | A | | 2/1882 | Schultz | |
| 340,176 | A | | 4/1886 | Wardwell, Jr. | |
| 351,101 | A | | 10/1886 | Fauber | |
| 355,817 | A | * | 1/1887 | Grube | 108/19 |
| 606,084 | A | * | 6/1898 | Poupon | 108/65 |
| 687,712 | A | * | 12/1901 | D'Apery | 108/83 |
| 722,577 | A | * | 3/1903 | Gregory | 108/66 |
| 838,671 | A | | 12/1906 | Turner | |
| 1,384,925 | A | | 7/1921 | Seiler | |
| 1,547,685 | A | * | 7/1925 | Rhodes | 108/66 |
| 1,993,787 | A | | 3/1935 | Howe | |
| 2,110,068 | A | * | 3/1938 | Kowalski | 108/79 |
| 2,492,139 | A | * | 12/1949 | Eliason | 108/66 |
| 3,683,825 | A | | 8/1972 | Sheldon | |
| 4,036,150 | A | * | 7/1977 | Algier | 108/65 |
| 4,677,920 | A | * | 7/1987 | Eccardt | 108/69 |
| 4,782,764 | A | | 11/1988 | Robinson | |
| 4,809,619 | A | | 3/1989 | Piretti | |
| 4,815,393 | A | * | 3/1989 | Pollak | 108/69 |
| 5,156,095 | A | | 10/1992 | Hansbaek et al. | |
| 5,237,937 | A | | 8/1993 | Peltier et al. | |
| 5,425,313 | A | | 6/1995 | Rowan | |
| 5,458,070 | A | | 10/1995 | Gamba et al. | |

(Continued)

FOREIGN PATENT DOCUMENTS

| | | |
|---|---|---|
| GB | 6788 | 0/1835 |

(Continued)

*Primary Examiner*—José V Chen
(74) *Attorney, Agent, or Firm*—Venable LLP; Henry J. Daley; Ryan M. Flandro

(57) ABSTRACT

An expandable table of the type in which a number of table top sections are caused to move outwardly and expand upon rotation of the table top and a center alignment assembly for such an expandable table. The center alignment assembly includes a first plate member adapted to be secured to a center portion of a guide plate of the expandable table, a plurality of fasteners arranged to be attached to the plate member to define a plurality of receiving structures, and a plurality of second plate members adapted to be secured to each of a plurality of separate table top sections moveably arranged over a top surface of the guide plate, wherein each of the plurality of second plate members includes a projecting member adapted to be received in one of the receiving structures.

10 Claims, 18 Drawing Sheets

U.S. PATENT DOCUMENTS

| | | | | |
|---|---|---|---|---|
| 6,009,814 | A | 1/2000 | Rossi | |
| 6,994,032 | B2 | 2/2006 | Conley et al. | |
| 7,455,018 | B2 * | 11/2008 | Conley et al. | 108/65 |
| 7,464,653 | B2 * | 12/2008 | Dodge | 108/86 |
| 2006/0124037 | A1 | 6/2006 | Conley et al. | |
| 2007/0251429 | A1 | 11/2007 | Conley et al. | |

FOREIGN PATENT DOCUMENTS

| | | | |
|---|---|---|---|
| WO | WO 2004/089158 | A1 | 10/2004 |

* cited by examiner 412
440
416
412
440
416
405
412
440
412
440
412
440

EXPANDABLE TABLE AND CENTER ALIGNMENT ASSEMBLY FOR SUCH AN EXPANDABLE TABLE

BACKGROUND

1. Field of Invention

The present invention relates to furniture, and more particularly, to expandable tables.

2. Discussion of Related Art

In 1835, Robert Jupe was granted British Patent No. 6788 for an expandable table. The original Jupe expandable table includes a table top that is divided into a number of sections. Each section is connected to an underlying frame structure, such that when the table top is rotated, the sections move radially outwardly, increasing the effective size of the table top. Once the table top has been rotated to move the table top sections to an expanded configuration, leaves are inserted between the sections, so as to fill in the spaces created by the outwardly positioned sections. Because the table top sections diverge and move radially outward from a central point, the Jupe table top retains its shape in its expanded configuration.

The Jupe table has now become one of the most valuable and sought after antiques. Original Jupe tables in good condition may sell for up to $350,000 or more. However, despite its popularity, the Jupe table has been very difficult to mass produce, because its workings are both extremely complex and entirely handcrafted to high levels of tolerance.

For example, the frame structure that supports the table top sections in the Jupe table is comprised of many individual beam structures that are secured together to form the frame. Each of those beams must be individually made and assembled to exacting tolerances in order to ensure that the table top sections will move freely and mate in the center of the table top to form a substantially contiguous table surface in both the contracted and expanded configurations. The manufacture of such a structure is time-consuming and is not conducive to rapid production.

Other aspects of the Jupe table design also make the design difficult to implement. For example, in at least some of the existing examples of functioning Jupe tables, the pivot for the table top is a threaded rod that runs the entire length of the table pedestal. This can be an extremely difficult and time-consuming, and therefore expensive, configuration to replicate.

Additionally, each table top section in a Jupe table includes a hand carved tenon structure which is received by a central piece that has correspondingly hand carved mortise structures. The central piece locks the table top sections in place relative to one another when the table is in its unexpanded configuration, but minor misalignments in the carving of these can result in the table top sections being unable to engage the central piece to form a contiguous table surface.

In general, even when hand made to the appropriate tolerances and correctly assembled, Jupe tables are especially susceptible to the effects of friction and wear. They require careful handling and frequent maintenance to ensure smooth movement.

SUMMARY

In an embodiment of the invention, an improved expandable table has a table support structure; a guide plate mounted on the table support structure; and a plurality of separate table top sections moveably arranged over a top surface of the guide plate between a first closed position and a second expanded position. The expandable table according to this example further includes a center alignment assembly having a first plate member secured to a center portion of the guide plate; a plurality of fasteners attached to the first plate member and arranged to define a plurality of receiving structures; and a plurality of second plate members, each second plate member secured to one of the plurality of separate table top sections and including a projecting member adapted to be received in one of the receiving structures when the plurality of separate table top sections are in the first closed position.

In another embodiment of the invention, a center alignment assembly for an expandable table is provided. The center alignment assembly may include a first plate member adapted to be secured to a center portion of a guide plate of the expandable table; a plurality of fasteners adapted to be attached to the first plate member in an arrangement that defines a plurality of receiving structures; and a plurality of second plate members adapted to be secured to each of a plurality of separate table top sections moveably arranged over a top surface of the guide plate. Each of the plurality of second plate members includes a projecting member adapted to be received in a respective one of the receiving structures.

BRIEF DESCRIPTION OF THE DRAWINGS

Examples for some embodiments of the invention will be described with respect to the following drawings, in which like reference numerals represent like features throughout the figures, and in which.

DETAILED DESCRIPTION

Figure 1:
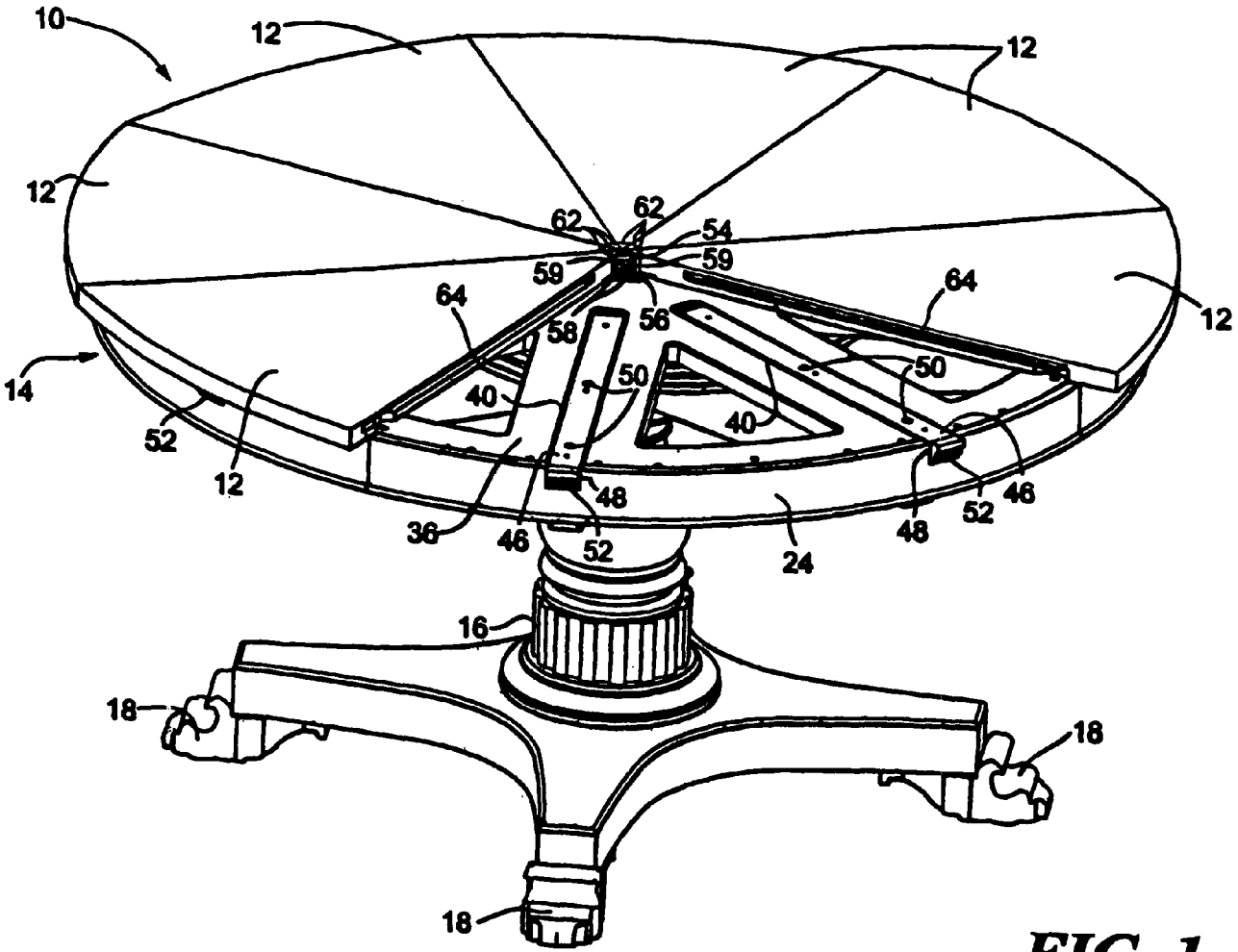
FIG. 1 is a perspective view of an example of an expandable table according to an embodiment of the invention with several of the table top sections removed so as to show the underlying structures and mechanisms.

In describing the examples for some embodiments of the present invention and illustrated in the drawings, specific terminology is employed for the sake of clarity. However, the invention is not intended to be limited to the specific terminology so selected. It is to be understood that each specific element includes all technical equivalents that operate in a similar manner to accomplish a similar purpose.

An expandable table 10 according to an embodiment of the invention is shown in the perspective view of FIG. 1, also described in commonly-owned U.S. Pat. No. 6,994,032, issued Feb. 7, 2006, the entirety of which is incorporated herein by reference. The table 10 is of the type in which a plurality of table top sections 12 slide outwardly simultaneously in response to a rotation of the table top 14 and outer edge structure 24 so as to expand the effective surface area of the table top 14.

The table top 14 of the table 10 has a generally circular shape, although other shapes, such as oval and rectangular, are contemplated within the scope of the invention, and will be described below with respect to other examples of some embodiments of the invention. In the view of FIG. 1, the table 10 is in its unexpanded configuration, and two of the table top sections 12 have been removed to illustrate portions of the articulation mechanism of the table 10.

A pedestal 16 supports the table top 14 above floor level at a convenient height, which may be selected as desired. The pedestal 16 is generally vertical in orientation and includes four feet 18 at its base, although various configurations are possible, and any support member that maintains the table top 14 at an appropriate height above floor level may be used. The pedestal 16 may be sculpted or contoured for a decorative effect, as is shown in FIG. 1.

Figure 2A:
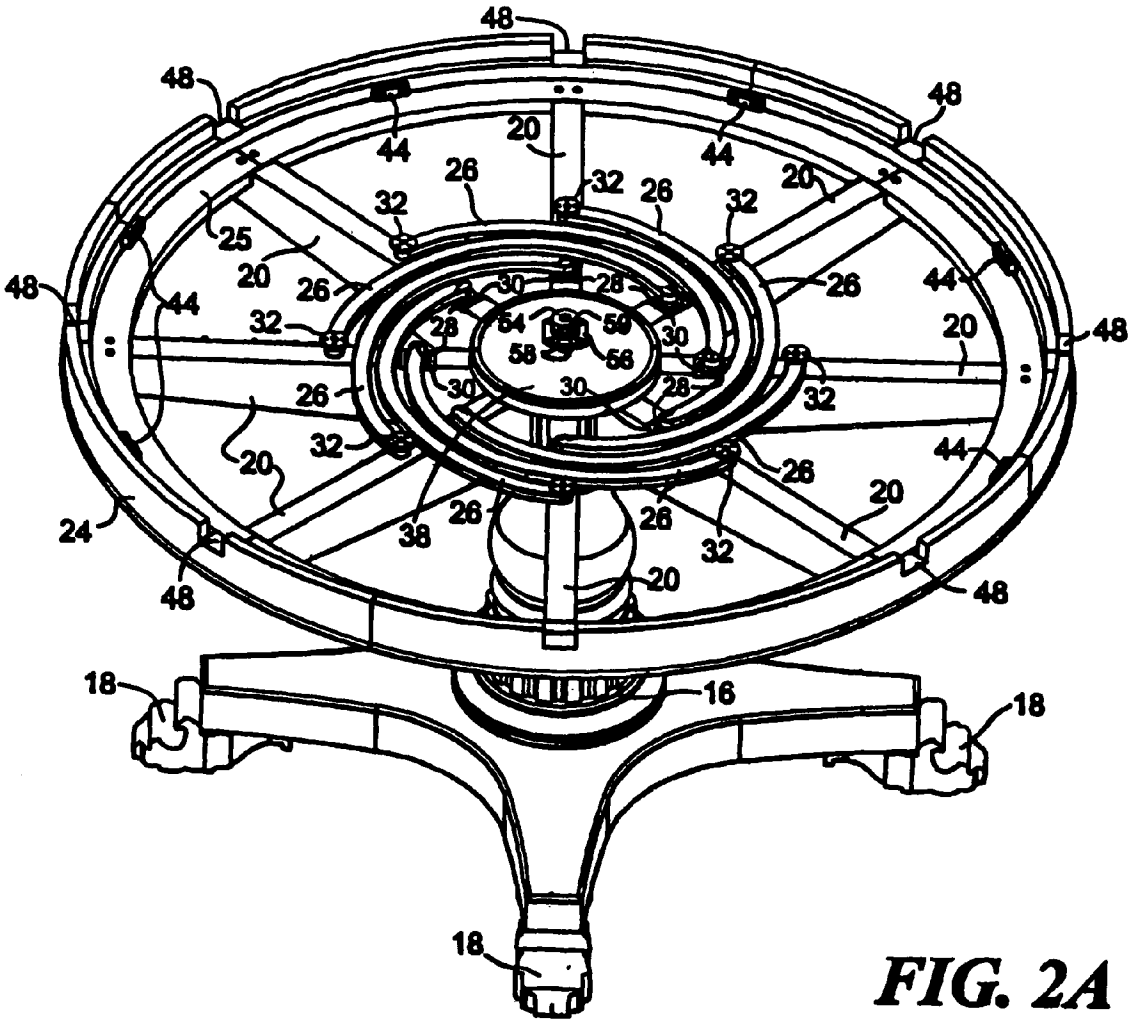
FIGS. 2A and 2B are perspective views of the table of FIG. 1 with the table top sections and guide plate removed, so as to show the table top support structure and the rotating members secured thereto in first and second operative positions, respectively.
Figure 2B:
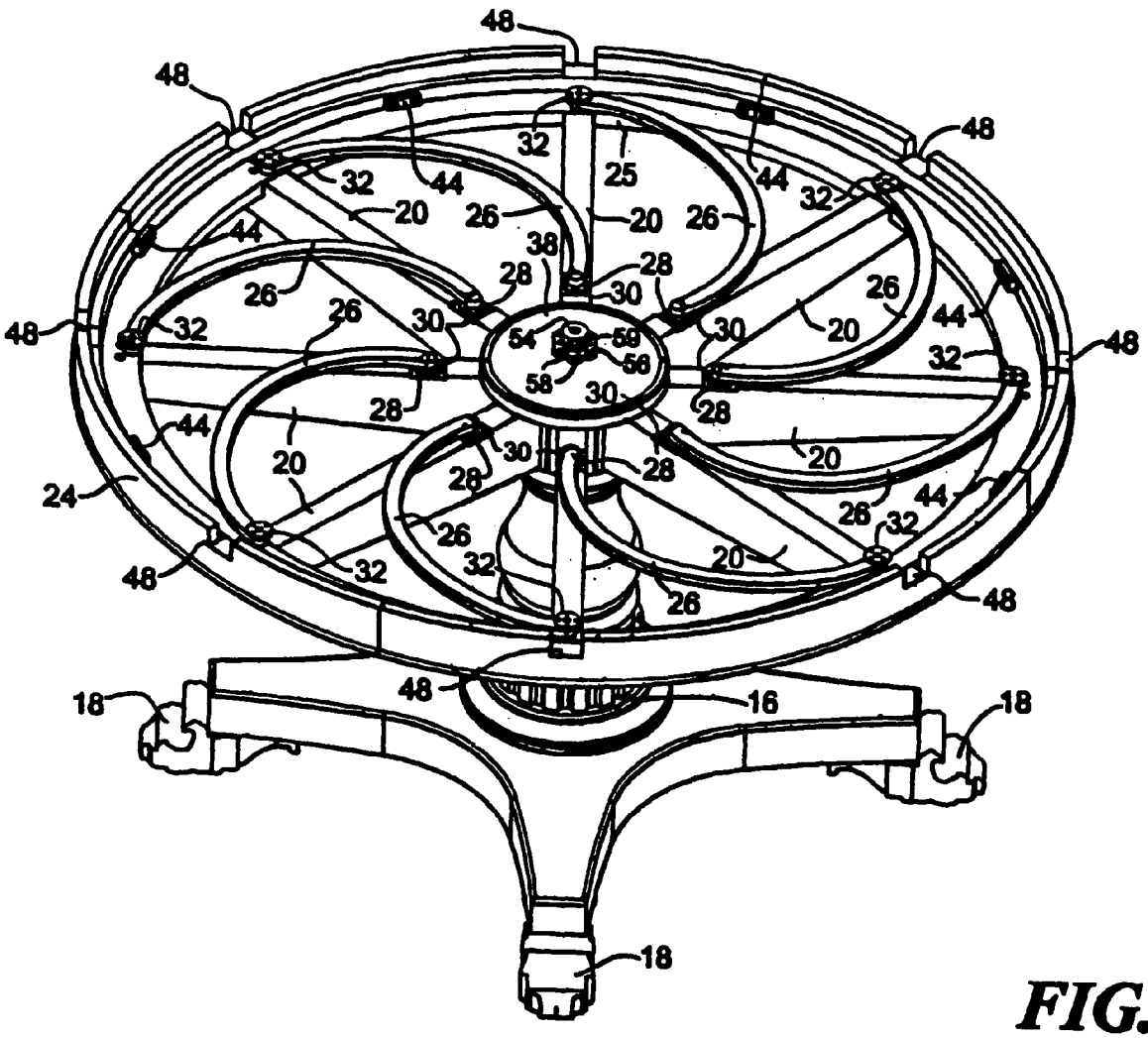
Figure 3:
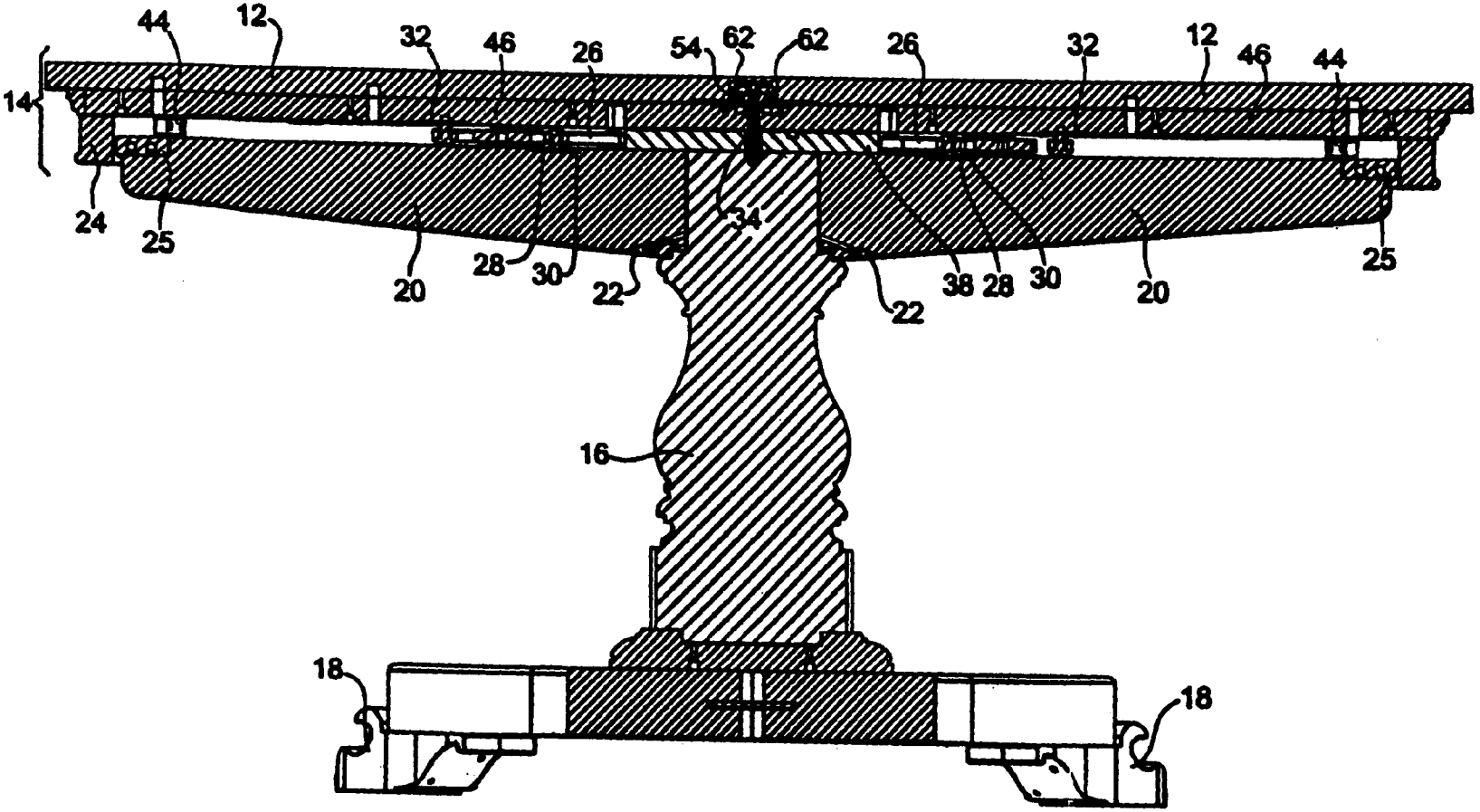
FIG. 3 is a cross-sectional view of the table of FIG. 1.

The construction of the table top 14 can be seen in FIGS. 2A, 2B, and in the cross-sectional view of FIG. 3. (In FIGS. 2A and 2B, certain components of the table top 14 are not present in the view, so as to show the remaining components with more clarity, as will be explained below.) As shown in FIGS. 2A, 2B, and 3, a number of support arms 20 are mounted about the circumference of the pedestal 16 using dovetail joints between the support arms 20 and the pedestal 16. Fasteners (not shown in the Figures) are also secured in a number of holes 22 provided in the support arms 20, primarily to hold the support arms 20 to the pedestal 16 while the dovetail joints are set (for example, with adhesives). Although dovetail joints are used in this example of an embodiment of the invention, any conventional joining process or structure may be used. Eight support arms 20 are provided for the table top 14, although more or less may be provided. The support arms 20 extend generally outwardly from the pedestal 16 and are generally co-planar, so as to provide a relatively level support for the table top 14.

A support rim 25 extends around the circumference of the circle defined by the free ends of the support arms 20 and provides a continuous, fixed contact surface along the free ends of the support arms 20. Outer edge structure 24 rests on the support rim 25 and extends upwardly from it to define the outer edge of the table top 14. The features of the outer edge structure 24 will be described in more detail below.

On an inner portion of each support arm 20, proximate to the pedestal 16, an arcuate rotating member 26 is mounted for rotation about a vertical rotational axis by a downwardly-facing engaging end 28 of the rotating member 26 that is secured within a shallow trough 30 provided in the support arm 20. The downwardly-facing engaging end 28 of the rotating member 26 is mounted in the trough 30 by threaded fasteners and forms a hinged pin joint in the illustrated example of an embodiment of the invention, although other mounting configurations could be used. The trough 30 accommodates the height of the mounting hardware used to mount the downwardly-facing engaging end 28 of the rotating member 26, so that the height of the mounted rotating member 26 does not exceed a desired height, such that other components may be mounted on the rotating members 26 without exceeding the height of the outer edge structure 24.

As mounted on the support members 20, the arcuate rotating members 26 may rotate between "closed" positions, in which the free, upwardly-facing ends 32 of the rotating members 26 are proximate to the pedestal 16, and "open" or "expanded" positions, in which the free, upwardly-facing ends 32 of the rotating members 26 are proximate to the outer edge structure 24. FIG. 2A illustrates the "closed" positions of the rotating members 26, and FIG. 2B illustrates the "open" or "expanded" positions of the rotating members 26.

The rotating members 26 may have several different radii of curvature along their lengths. The precise radii of curvature used in the rotating members 26 may be readily determined by those skilled in kinematics, given the desired initial and final positions of the rotating members 26. The use of several radii of curvature along the length of the rotating members 26 permits one to manufacture the rotating members 26 sufficiently precisely and economically. However, continuously varying, smoothly curved rotating members are also within the scope of the invention.

As shown in the cross-sectional view of FIG. 3, a threaded rod 34 is fixedly mounted within an upper portion of the pedestal 16 such that it extends upwardly from the pedestal 16 and acts as a central rotational axis for the table top 14. Rotatably mounted over the threaded rod 34 and on the pedestal 16 is a guide plate 36. The guide plate 36 is partially visible in FIG. 1, but is not shown in FIGS. 2A and 2B; it is best shown in the perspective views of FIGS. 4 and 6.

The guide plate 36 is a generally circular plate that has a number of linear slots 40 formed in it. Although the guide plate 36 is shown as being circular in this embodiment, it is generally not limited to only circular shapes. The linear slots 40 extend from an inner central portion of the guide plate 36 radially outwardly toward the edge of the guide plate 36. The number of linear slots 40 corresponds to the number of rotating members 26 provided in the table 10. Each linear slot 40 is sized and adapted to at least partially receive a free, upwardly-facing end 32 of one of the rotating members 26 so as to engage the free, upwardly-facing end 32 for sliding movement within the linear slot 40. The linear slots 40 are sized so that the positions of the ends of the slots 40 that are proximate to the pedestal 16 correspond to the positions of the free, upwardly-facing ends 32 of the rotating members 26 when they are in the "closed" position illustrated in FIG. 2A.

By receiving the free, upwardly-facing end 32 of each rotating member 26 in a slot 40, the guide plate 36 constrains all of the rotating members 26 to move substantially simultaneously and coincidentally such that their upwardly facing ends 32 move between the ends of the linear slots 40. (The upwardly-facing ends 32 have the same type of hinged pin joint as the downwardly-facing ends 28, although the joints or mounting strictures of the two ends 28, 32 may be different in different embodiments.) In general, the arrangement is such that a rotational movement of the guide plate 36 is translated into a radially inward or outward movement of the upwardly facing ends 32 of the rotating members 26.

The guide plate 36 illustrated in the Figures also includes open sections 42 from which the material has been cut out or otherwise removed. The inclusion of open sections 42 reduces the weight of the guide plate 36 and, therefore, makes it easier for the user to rotate the guide plate 36. In the illustrated example of an embodiment of the invention, the open sections 42 are generally sector-shaped, such that the guide plate 36 as a whole has a "hub-and-spoke" configuration. However, those of ordinary skill in the art will realize that the inclusion of open sections 42 is optional, and that, if provided, the open sections 42 may have substantially any shape. In the guide plate 36, enough material (e.g., wood) remains between the open sections 42 and the linear slots 40 so that the mechanical strength required by the linear slots 40 is not compromised.

Whereas the original Jupe rotating table design used a frame comprised of multiple precision-crafted parts to guide the movements of the table top sections, a single piece guide plate, such as guide plate 36, is easier to manufacture and presents less of a consistency and tolerance problem. Additionally, the table 10 is far easier to assemble because of the guide plate 36 than a comparable original Jupe table would be. As was described above, assembly of the frame structure of the Jupe table is a precision, hand-crafted and labor-intensive process.

Towards its center, the guide plate 36 rests on and slides against a center plate 38 that is secured to the pedestal 16. At its outer edge, the guide plate 36 is supported by rub blocks 44 (best shown in FIGS. 2A and 2B) that are secured to the inner perimeter of the outer edge structure 24. A lower face of each rub block 44 is designed to slide against the support rim 25; the upper face of each rub block 44 is designed to rest against the lower surface of the guide plate 36. The rub blocks 44 are designed to support the guide plate 36 and outer edge structure 24 and reduce the friction required to rotate them. The rub blocks 44 are constructed of a low-friction plastic material, such as, for example, DELRIN® (acetal polymer sold by DuPont, Inc., Wilmington, Del., United States) or high density polyethylene, although DELRIN® is currently preferred for most applications. In other example embodiments, ultra high molecular weight polyethylene (UHMW) may, for example, be used. In general, the material of the rub blocks 44 should have high stiffness, low coefficient of friction, and resistance to abrasion. It is also desirable for the rub blocks 44 to have chemical resistance, particularly to the types of oils, finishes and lubricants that might be used on the table 10. The number, size, and location of the rub blocks 44 may be selected as desired. However, it is generally desirable to provide enough rub blocks 44 substantially evenly spaced around the perimeter of the table top 14, so as to provide the guide plate 36 with even support. Eight rub blocks 44 are used in the table 10. In table 10 according to the example embodiments of the invention, it is contemplated that the rub blocks 44 may carry much of the weight of the guide plate 36 and outer edge structure 24.

The guide plate 36 is rotatably mounted on the pedestal 16 at its center and received within the outer edge structure 24 such that its lower surface rests on the rub blocks 44 and its top surface is generally flush with the top of the outer edge structure 24. Within each one of the linear slots 40, an elongate guide 46 is mounted (two of the eight guides 46 are shown in FIG. 1). The guides 46 are mounted on the respective upwardly facing ends 32 of the rotating members 26 such that they slide inwardly and outwardly within the linear slots 40 when the guide plate 36 is rotated to move the rotating members 26.

Figure 6:
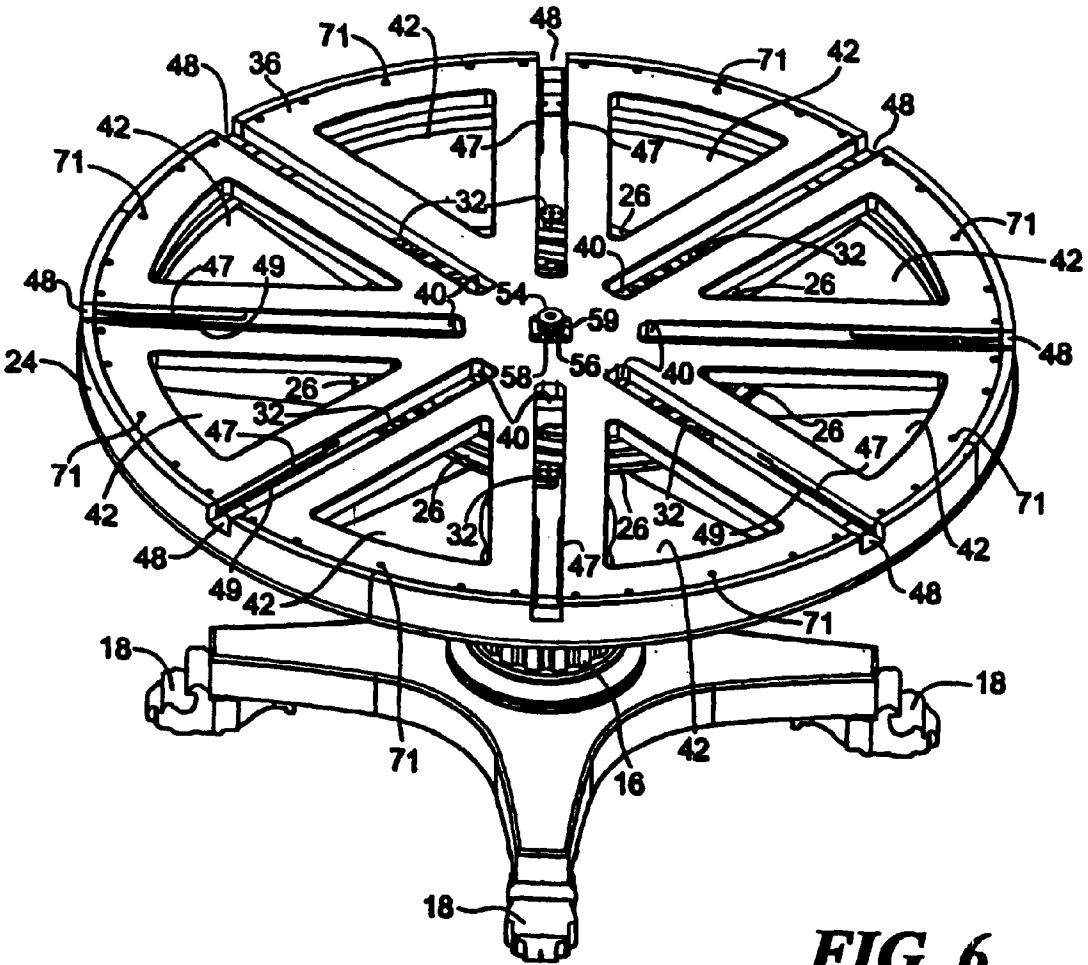
FIG. 6 is a perspective view of the table of FIG. 1 with the table top sections removed.

As shown in FIG. 6, each of the linear slots 40 has a spline 47 mounted within, along the inner periphery of the linear slot 40. The splines 47 are comprised of a graphite and carbon fiber composite material and include tracks 49 formed therein. Alternatively, the splines 47 could be comprised of DELRIN® or one of the polyethylene materials described above. The tracks 49 are designed to slidingly engage projecting structures of the guides 46 (not shown in FIG. 6) so as to mount the respective guides 46 for sliding movement engaging the splines 47 within the linear slots 40.

The guides 46 are positioned relative to the outer edge structure 24 so that they may slide in and out of the slots 48 in the outer edge structure 24 and the linear slots 40 cut in the outer edge structure 24. Because they extend through both the slots 48 and the linear slots 40, the guides 46 also couple the movement of the guide plate 36 and outer edge structure 24 so that the guide plate 36 rotates with the outer edge structure. Each guide 46 provides holes or other receptacles 50 for mounting one of the table top sections 12. The outer ends 52 of the guides 46 may be provided with a decorative appearance, because the outer ends 52 may be visible to the user.

Figure 4:
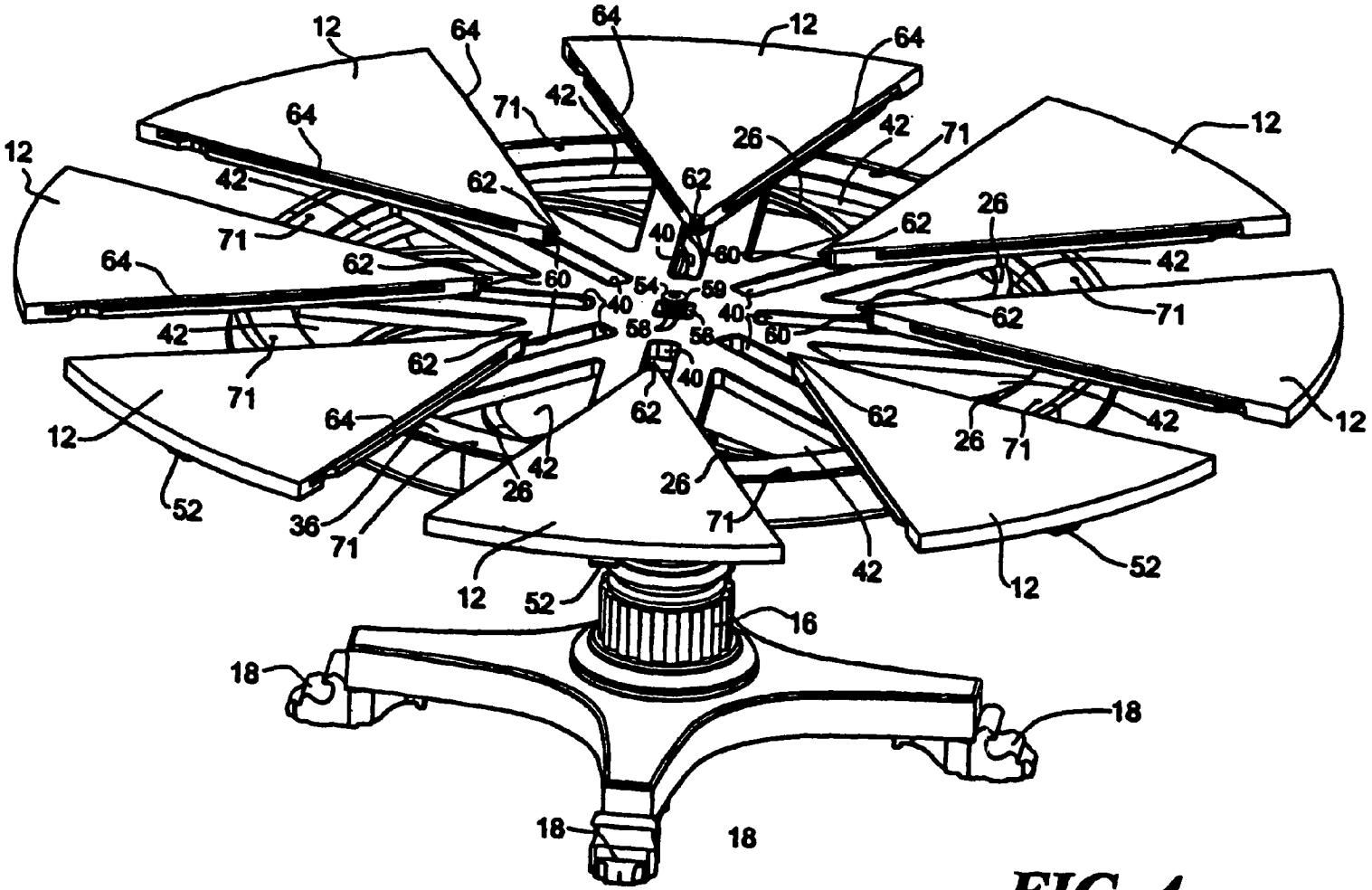
FIG. 4 is a perspective view of the table of FIG. 1 in an expanded configuration without table leaves installed.

One table top section 12 is mounted on each guide 46, the overall arrangement being such that a clockwise rotational movement of the table top 14 (including the outer edge structure 24) causes the rotating members 26 to move outwardly along the linear slots 40 in the guide plate 36, which, in turn, causes the guides 46 and the table top sections 12, which are mounted on the guides 46 to move outwardly. Conversely, a counter-clockwise rotation of the table top 14 causes the rotating members 26 and table top sections 12 to move inwardly. The direction of rotational movement that causes an inward or outward movement may be arbitrarily selected. For example, if the rotating members 26 are arranged in a reverse orientation from that illustrated in the figures, a counter-clockwise movement of the table top 14 may cause the table top sections 12 to move outwardly. FIG. 4 illustrates the expanded position of the table 10, with the table top sections 12 in the outward position.

Figure 7:
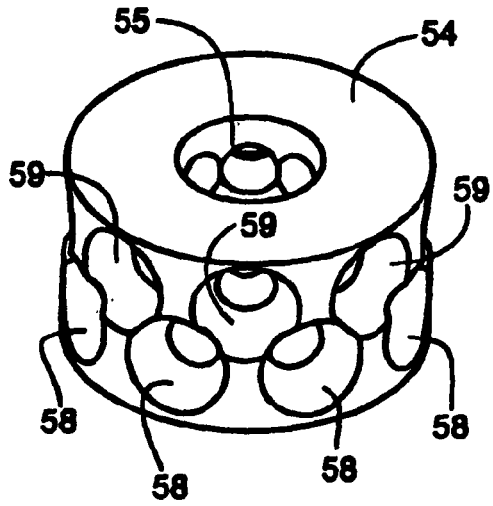
FIG. 7 is a perspective view of an example of a king piece included in the table of FIG. 1.

In one example for an embodiment of the invention, at the center of the table top 14, where all of the table top sections meet when the table 10 is in the unexpanded configuration, a king piece 54 is mounted on a king plate 56, which, in turn, is mounted to the guide plate 36 so that the king piece 54 and plate 56 rotate with the guide plate 36. FIG. 7 is a perspective view of the king piece 54 in isolation. As shown in the example embodiment depicted in FIG. 7, the king piece 54 is generally cylindrical in shape and includes two rows of hole-receptacles, one row of lower hole-receptacles 58 and one row of upper hole-receptacles 59 evenly spaced about its circumference. Each receptacle 58, 59 is sized to receive a projection 60 provided on a bracket 62 that is fastened to the inner edge of each table top section 12 and each table leaf 66. (The table leaves 66 will be described in more detail below.)

The hole-receptacles 58, 59 have a generally horizontally-extending funnel shape with sloped wall portions. The funnel shape of the hole-receptacles 58, 59 facilitates the alignment of the hole-receptacle 58, 59 with respect to the projection 60, in that if a minor misalignment occurs during the engagement process, the funnel shape of the hole-receptacle 58, 59 will guide the projection 60 towards the center of the hole-receptacle 58, 59. Similarly, the projection 60 may be provided with a tapered shape, which may assist in the alignment process during mating. At its center, the king piece 54 includes a counterbored hole 55 sized to accommodate the threaded rod 34, which passes through the king plate 56 and secures the king piece 54 and king plate 56 rotatably to the pedestal 16.

Figure 8:
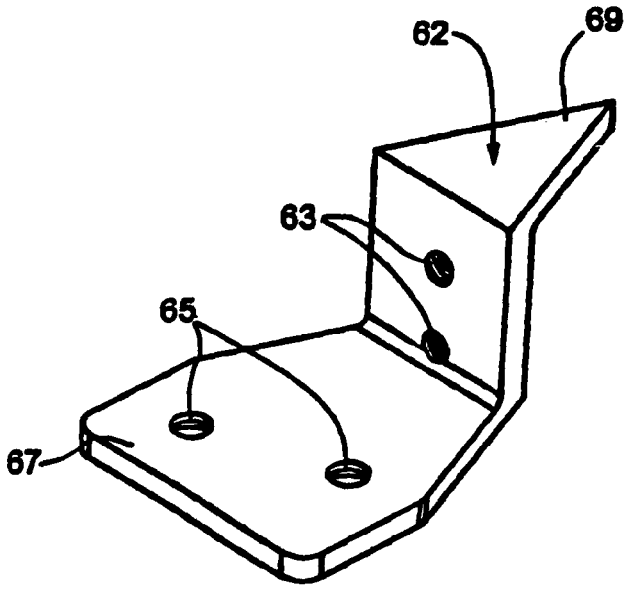
FIG. 8 is a perspective view of an example of a bracket adapted to mate with the king piece of FIG. 7.

FIG. 8 is a rear perspective view of the bracket 62, according to an example embodiment of the invention. The bracket 62 is most advantageously designed so that the projection 60 may be removably mounted on the bracket 62 so as to be at the proper height to mate with either of the upper 59 or lower 58 rows of hole-receptacles of the king piece 54. Using that configuration, the same bracket 62 may be used on either a table top section 12 or a table leaf 66 by changing the position of the projection 60. In FIG. 8, two threaded holes 63 are provided in the bracket 62 for engaging a projection 60 that includes a corresponding threaded portion 60 along its length. The threaded holes 63 need not extend through the entirety of the bracket 62, although they do in the example embodiment illustrated in FIG. 8. The positions of the threaded holes 63 may be chosen to suit the design dimensions. Other moveable projection configurations are possible. For example, the projection 60 could be moveably secured within a vertically-extending slot in the bracket by an engaging nut or other similar structure.

FIG. 8 also shows the horizontally-extending portion 67 of the bracket 62. Two threaded holes 65 are provided in the horizontally-extending portion 67 so that the horizontally-extending portion 67 of the bracket 62 may be secured to the underside of a table top section 12. Typically, the threaded holes 65 would be bored for pan-head or other such screws that could be made flush with the lower face of the horizontally-extending portion 67.

When the projection 60 has engaged a receptacle 58, 59 in the king piece 54, the table top section 12 or table leaf 66 is "locked" in place with respect to the other table top sections 12. The engagement of the projections 60 and the receptacles 58, 59 "locks" the table top section 12 or table leaf 66 three-dimensionally; that is, the engagement prevents movement in the horizontal as well as vertical planes. The top of the bracket 62 has a triangular edge 69 that projects over the top of the king piece 54 to complete the table top 14.

On each side, each table top section 12 includes a tongue-and-groove structure 64 that is constructed and arranged to mate with the tongue-and-groove structures 64 of adjacent table top sections 12. The king piece 54, king plate 56, and brackets 62 may be made of a metal. If a decorative effect is desired, it may be advantageous to make those components from brass, for example.

Figure 5:
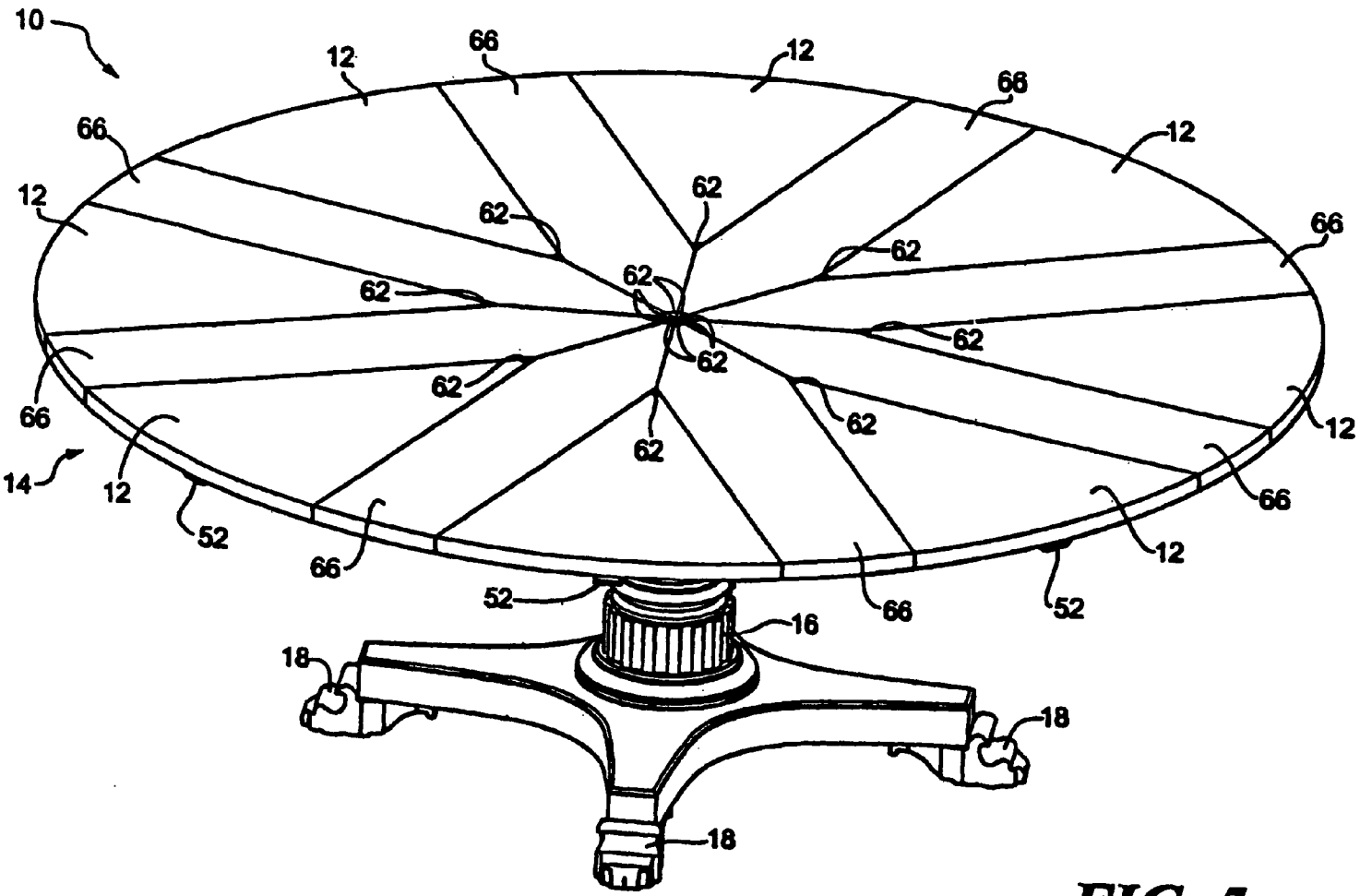
FIG. 5 is a perspective view of the table of FIG. 1 in an expanded configuration with table leaves installed.

As shown in FIG. 4, the expanded configuration of the table top sections 12 leaves substantial room between the sections. In order to fill the space, and to provide a contiguous table top surface in the expanded configuration, a number of table leaves 66 are placed on the guide plate 36. FIG. 5 is a perspective view of the table 10 in its expanded configuration with the table leaves 66 installed on the guide plate 36. In one example embodiment, each table leaf 66 has a generally pentagonal shape and includes a bracket 62 on its inner edge for engaging the king piece 54 to lock the table leaf 66 in place with respect to the table top sections 12 that are adjacent to it. The table leaves 66 also include tongue and groove structure (not shown in the Figures) for engaging the complimentary tongue and groove structures 64 of the table top sections.

The projections 60 in the brackets 62 of the table leaves 66 are positioned to engage the lower row of hole-receptacles 58 of the king piece 54. Similarly, the upper row of hole-receptacles 59 of the king piece 54 are positioned and adapted to engage the brackets 62 of the table top sections 12. As shown in FIG. 7, the upper row of hole-receptacles 59 is angularly offset from the position of the lower row of hole-receptacles 58.

In addition to the engagement of the king piece 54 with respective brackets 60, the guide plate 36 provides a number of locating pin holes 71 into which locating pins, such as, for example, wooden dowels, may be secured. The locating pins may be used to locate the table leaves 66 relative to the table sections 12, such that the table leaves 66 are located properly and do not slide relative to the guide plate 66 once they have been put into position.

The majority of the components of the table 10, including the pedestal 16, guide plate 36, and table top sections 12 may be constructed of any material. However, wood is one customary and preferred material for tables of this type. Typically, when wood is used as a material for conventional furniture, the dimensional tolerances specified are relatively great. In the case of the table 10, it is advantageous if the dimensional tolerances are kept relatively small, as minor variations in component size may cause friction-inducing misalignments, or may prevent the table top sections 12 from meeting at the king piece 54 to form a substantially contiguous table top surface.

As one example of the type of dimensional tolerances that are beneficial in a table such as table 10, if the table 10 has an overall diameter of about 84 inches in the expanded configuration and a height of about 30 inches, the table top sections 12, support arms 20, guide plate 36, and other wood components may be given dimensional tolerances of ±0.03 inches or less. The metal components, such as the king piece 54 and brackets 62 may be given dimensional tolerances of ±0.004 inches or less.

Typically, the table top sections 12, pedestal 16, and other components visible to the user have a visually attractive surface finish. In particular, if those components are wood, they may be stained and polished to a desired decorative finish.

Figure 9A:
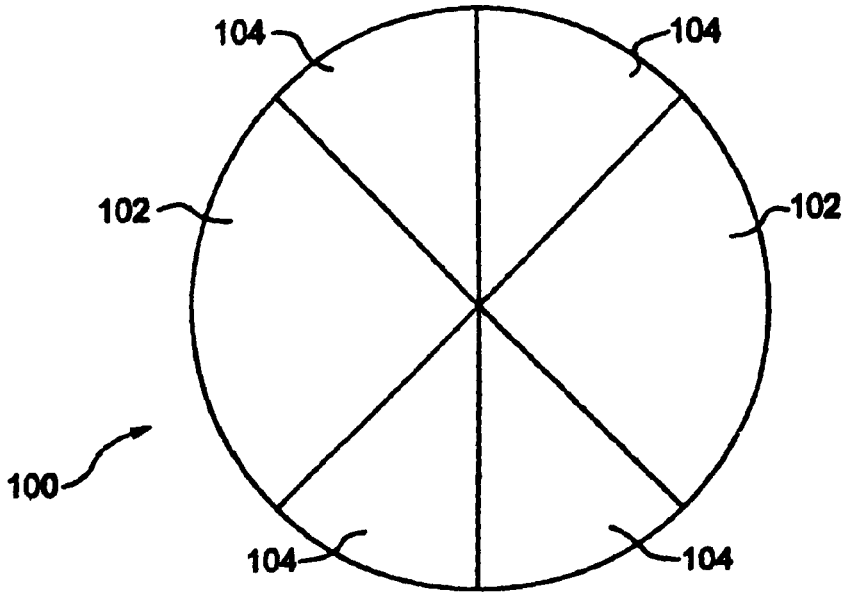
FIGS. 9A and 9B are schematic top plan views of an example of a table according to another embodiment of the invention.
Figure 9B:
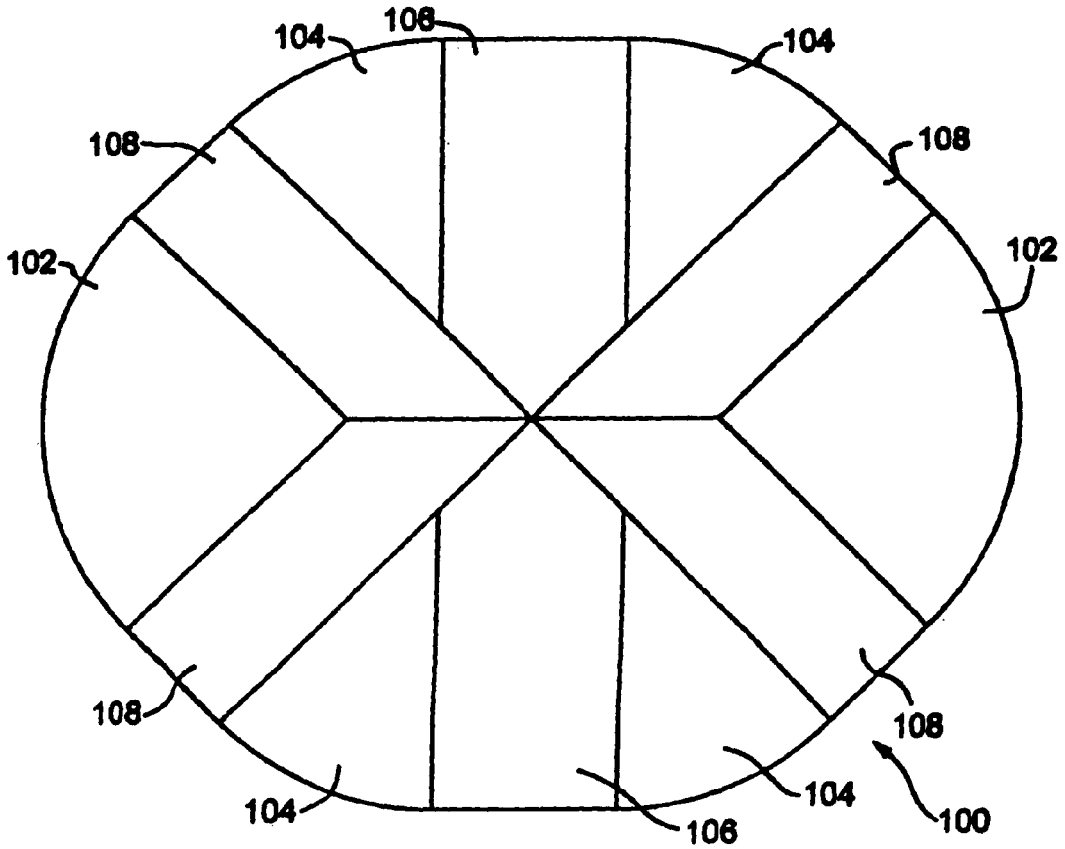

Although the table 10 in the example embodiment described above is round and remains round in its expanded configuration, tables of many different shapes and sizes may be made according to the principles of the present invention. For example FIGS. 9A and 9B are schematic top plan views of another table 100 according to another example embodiment of the invention. The table 100 has a round shape in its unexpanded configuration, as shown in FIG. 9A; however, its table top sections 102, 104 are of different sizes. Therefore, when the table 100 is in its expanded configuration, table leaves 106, 108 of different sizes, corresponding to the sizes of the gaps between the respective table top sections 102, may be inserted, giving the table 100 an oval shape in its expanded configuration, as shown in FIG. 9B.

Figure 10A:
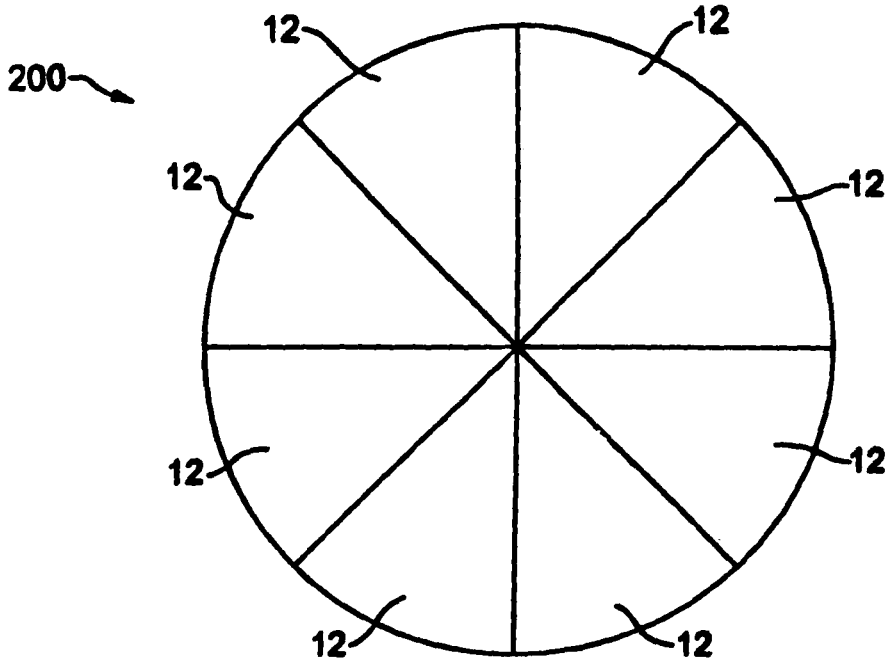
FIGS. 10A and 10B are schematic top plan views of an example of a table according to yet another embodiment of the invention.
Figure 10B:
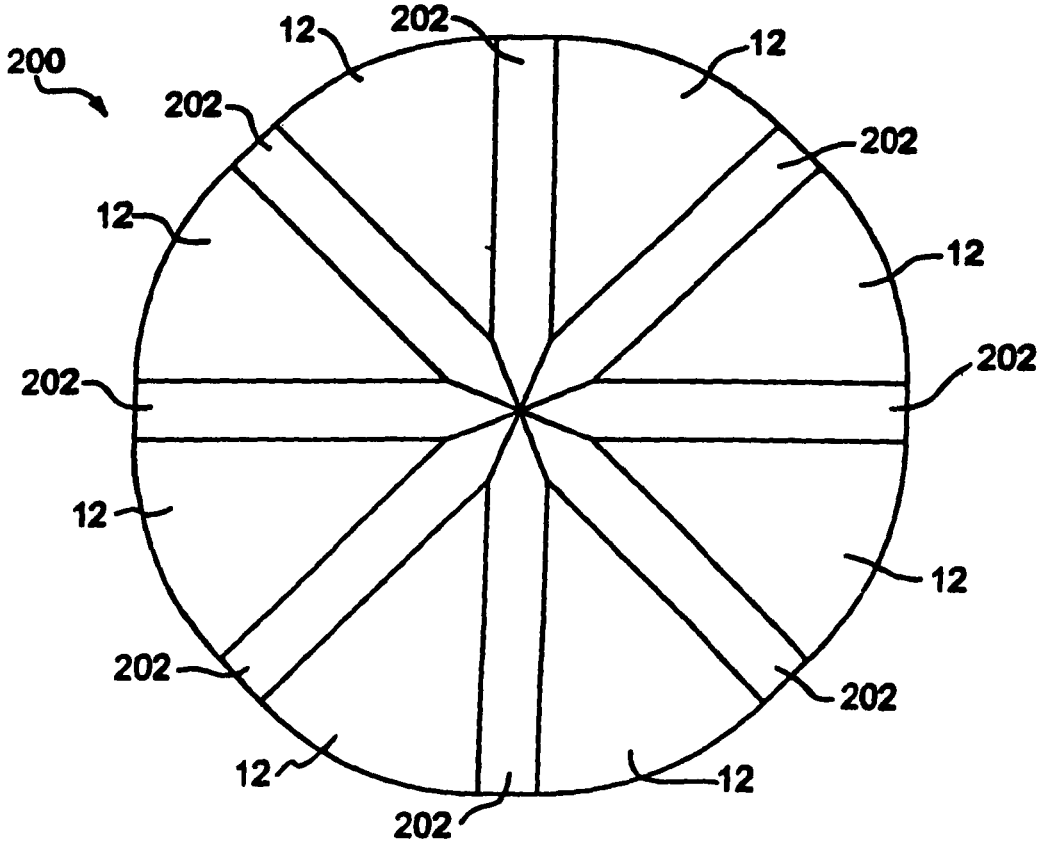

FIGS. 10A and 10B are schematic top plan views of another table 200 according to another example embodiment that is similar to the table 10 described above. The table 200 has a round shape in its closed configuration and table top sections 12 identical to those in the table 10, as shown in FIG. 10A. However, as shown in FIG. 10B, the table leaves 202 have straight, squared ends instead of rounded ends, giving the table 200 a semi-round shape in its expanded configuration.

Figure 11A:
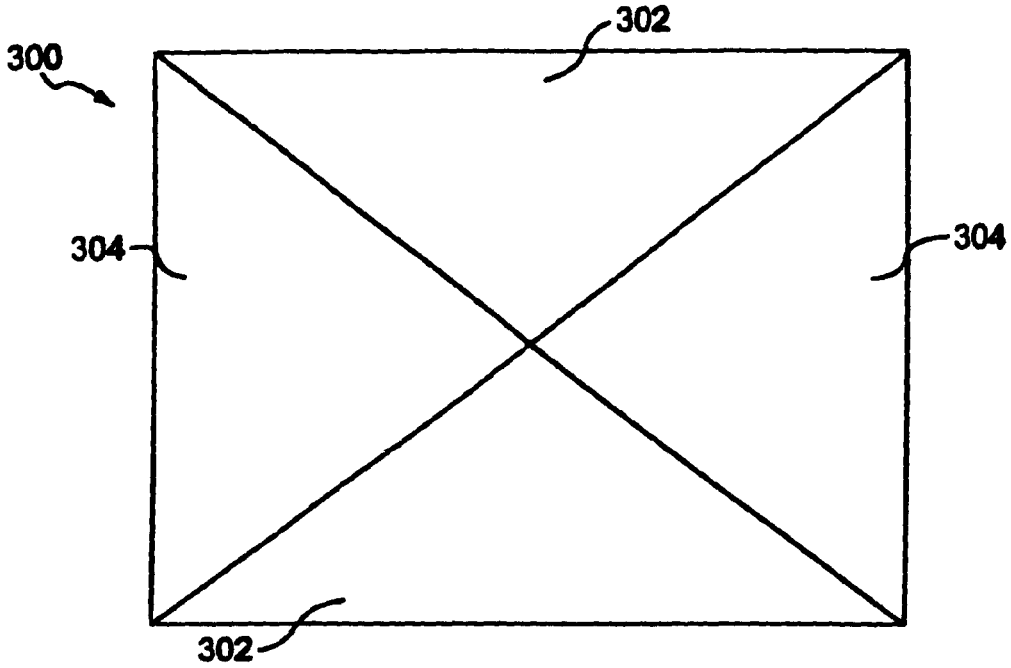
FIGS. 11A and 11B are schematic top plan views of an example of a table according to a further embodiment of the invention.
Figure 11B:
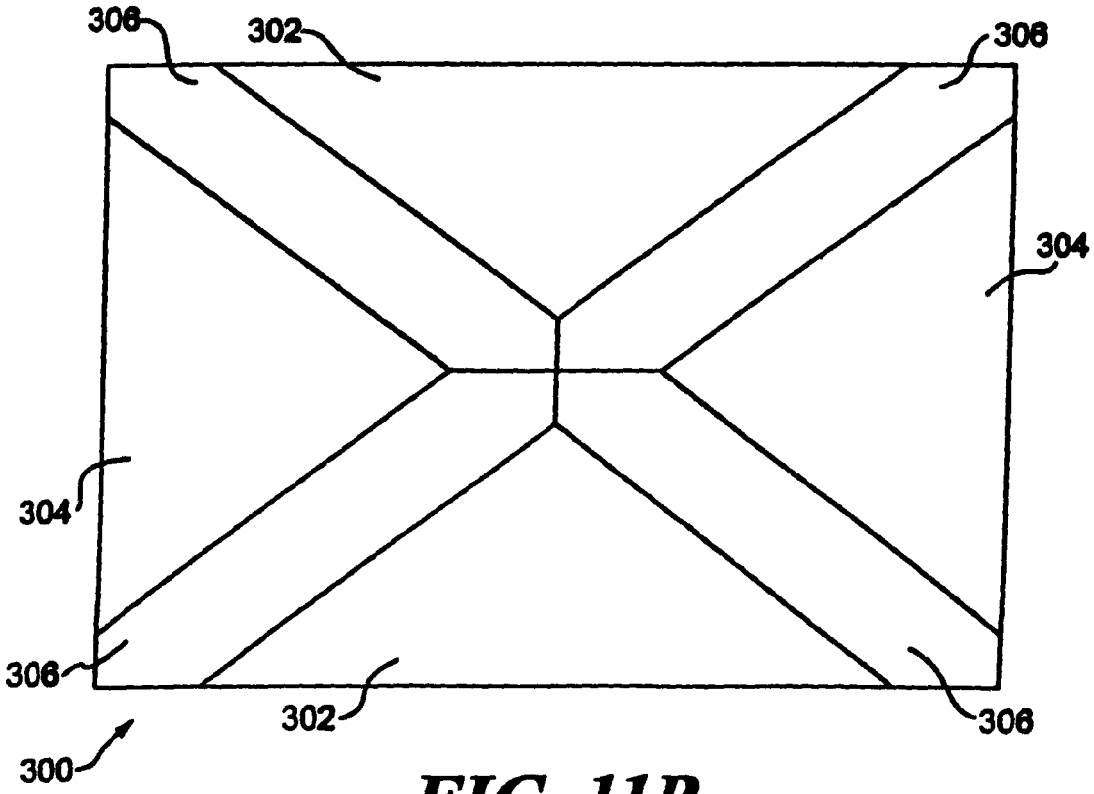

FIGS. 11A and 11B are schematic top plan views of a rectangular table 300 according to another example embodiment of the invention. Each of the table top sections 302, 304 is substantially triangular in shape, as shown in FIG. 11A. In the expanded configuration, shown in FIG. 11B, the table leaves 306 of the table 300 are shaped to maintain the rectangular shape of the table 300. Additionally, the table top sections and table leaves of a table similar to table 300 may be shaped so as to form a square table top when the table top leaves are in their closed position and a rectangular table top with the leaves inserted.

One of ordinary skill in the art will be able to calculate the required shapes of the king pieces and brackets necessary for tables 100, 200, and 300 based on the number of table top sections and the geometry of each section.

Figure 12:
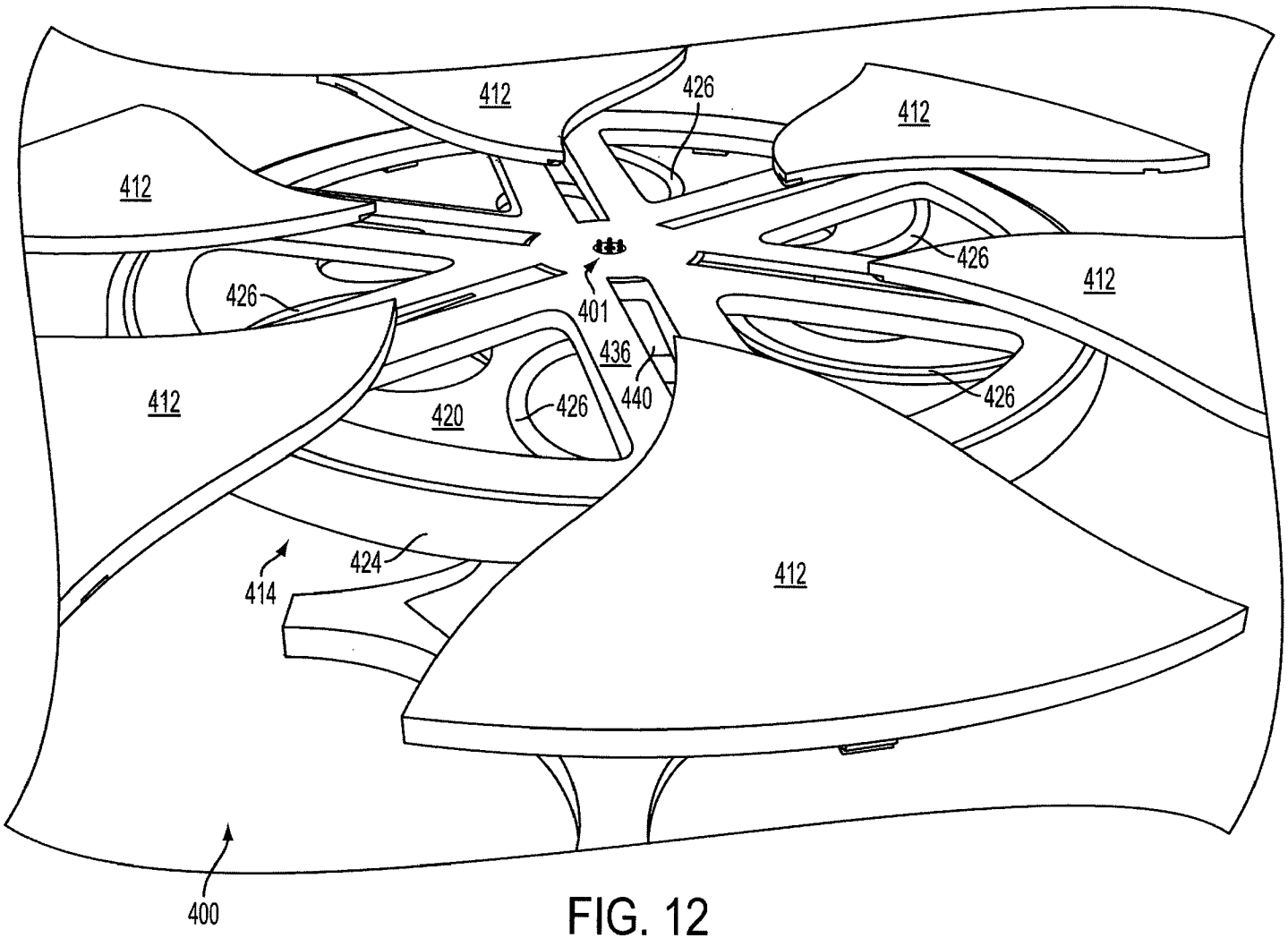
FIG. 12 is a perspective view of an example of an expandable table in the expanded configuration without table leaves installed between adjacent table top sections according to yet another embodiment of the invention.

FIG. 12 is a perspective view of an example of an expandable table 400 in the expanded configuration without table leaves installed between adjacent table top sections 412 according to yet another embodiment of the invention. The expandable table 400 is similar to the previously described embodiments, except that a center alignment assembly 401, discussed further below, is provided. The table top 414 of the expandable table 400 is rotatably mounted on a support structure 420 and includes a plurality of the arcuate rotating members 426 rotatably mounted to the support structure 420 and coupled to guides (not shown) of the respective table top sections 412 through linear slots 440 in the guide plate 436. In this embodiment of the invention, however, at the center of the table top 414, where all of the table top sections 412 meet when the table 400 is in the unexpanded configuration, a center alignment assembly 401 is provided on the guide plate 436 in place of the king piece 54 and king plate 56 described above. The center alignment assembly 401 is arranged to perform a function similar to the king piece 54, except that the manufacture and installation of the center alignment assembly 401 can be accomplished more readily and at a lower cost.

Figure 13:
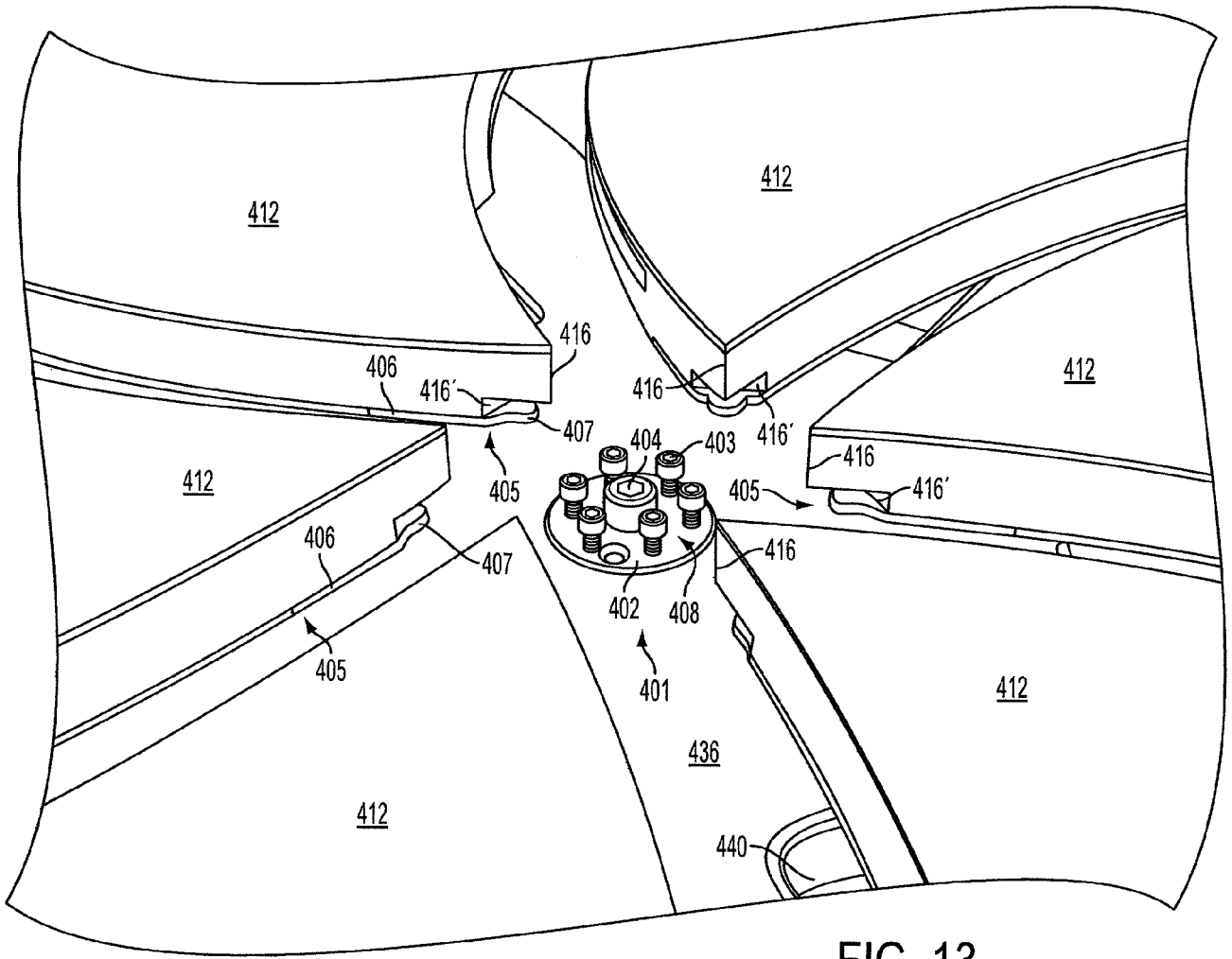
FIG. 13 is a perspective view of the expandable table of FIG. 12 in an intermediate configuration between the unexpanded and expanded configurations.
Figure 14:
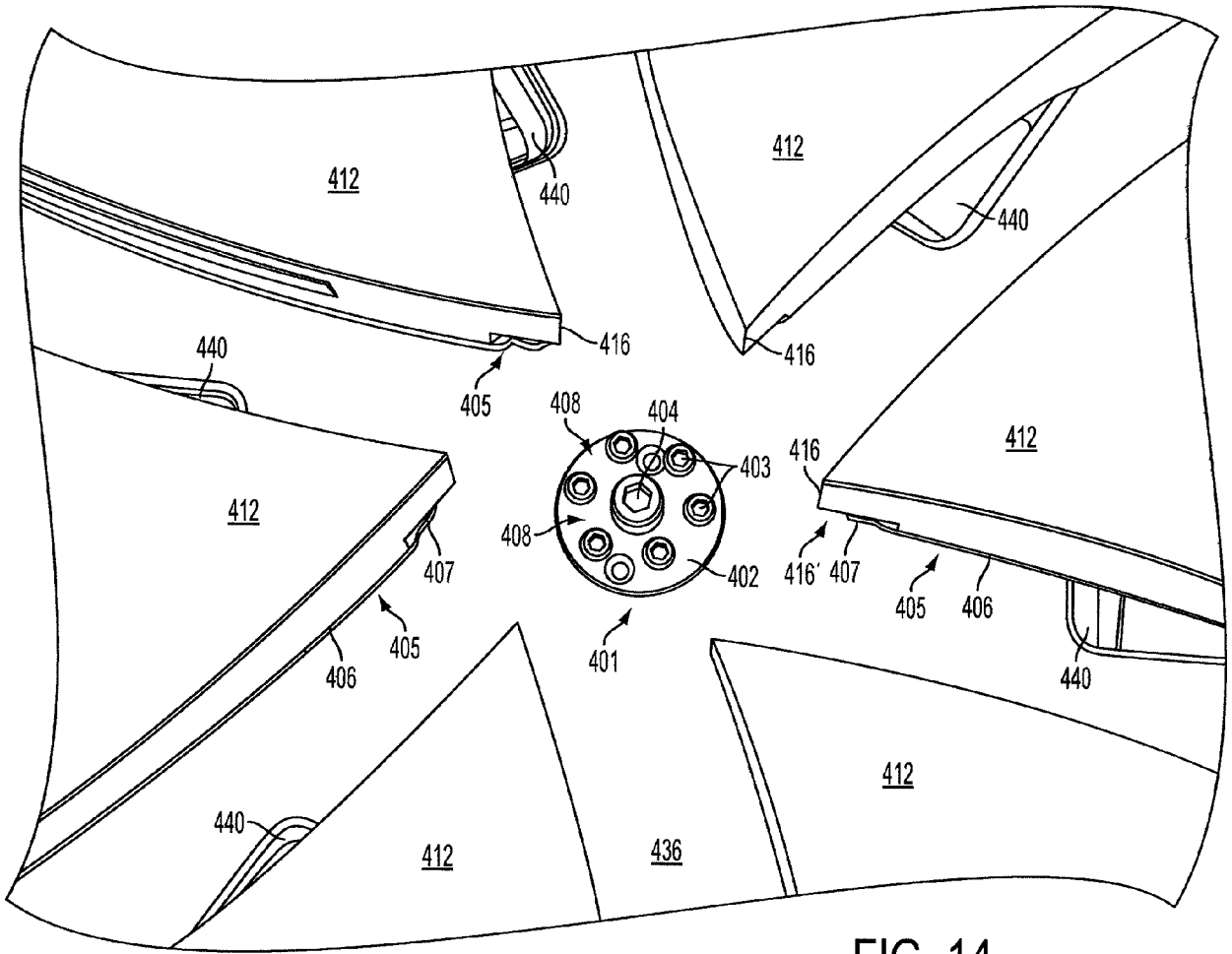
FIG. 14 is a plan view of the expandable table of FIG. 13 depicting the center alignment assembly.

FIG. 13 is a perspective view of the expandable table 400 of FIG. 12 in an intermediate configuration between the unexpanded and expanded configurations. FIG. 14 is a plan view of the expandable table 400 of FIG. 13 depicting the center alignment assembly 401 in further detail. As shown in FIGS. 13 and 14, at least a portion of the center alignment assembly 401 is fixedly mounted to the center of the guide plate 436, including a first plate member 402 and a plurality of fasteners 403 attached to the plate member 402. The first plate member 402 defines a substantially planar upper surface and may have the shape of a circular member, rectangular member, trapezoidal member, and/or any other multi-sided plate member. The first plate member 402 may also be made of any of a number of materials including, for example, metals or plastics, and, in particular, stamped or machined metal. The plurality of fasteners 403 are arranged at radially outward positions from a central axis A of the plate member 402 (see FIGS. 15 and 16) and are spaced from one another to define a plurality of receiving structures or openings 408. The fasteners 403 may each include an enlarged head portion and an elongated body portion such that the open space between adjacent fasteners 403 secured to the first plate member 402 define regions of restricted vertical and/or horizontal movement for elements received therebetween.

The center alignment assembly 401 may also include a center fastener 404 aligned with the central axis A and extending through the first plate member 402 and the guide plate 436 into the support structure 420. For example, the center fastener 404 may extend into a nut (not shown) disposed within the support structure 420 to adjustably secure the fastener 404 to the support structure 420. The first plate member 402 and the guide plate 436 are rotatably secured to the support structure 420 by the center fastener 404. The center fastener 404 can be any one of a variety of fastening elements such as, for example, bolts, screws, nails, rivets, and the like. Likewise, the plurality of fasteners 403 can be any one of a variety of fastening elements such as, for example, bolts, screws, nails, rivets, and the like, so long as they are configured to extend normal to the first plate member 402 and thereby form a plurality of receiving structures 408 adapted to receive respective projecting members 407 of each of a plurality of second plate members 405, as described further below. Although the center alignment assembly 401 shown in FIGS. 12-19 includes six fasteners 403, more or less fasteners 403 may be provided as will be apparent to one having ordinary skill in the art.

As shown in FIGS. 13 and 14, another part of the center alignment assembly 401 includes a plurality of second plate members 405. The second plate members 405 each include a body portion 406 secured to, or adapted to be secured to, a bottom of each of the plurality of separate table top sections 412, and a projecting member 407 adapted to be received in one of the receiving structures 408 when the plurality of separate table top sections 412 are in the unexpanded position. In the embodiment shown in FIGS. 13, 14, 17, and 18, the body portion 406 of the second plate member 405 is secured to a bottom of each respective table top section 412 proximate to a center edge 416 thereof and substantially conforms to the shape of the table top section 412. Other configurations for the body portion 406 of the second plate member 405 will be apparent to one of ordinary skill in the art and may or may not conform to the shape of the table top section 412. The second plate member 405 may also be secured to the respective table top sections 412 in any manner such as, for example, by fasteners or adhesive. The second plate member 405 is secured to the table top section 412 such that the projecting member 407 is positioned to be received in the receiving structures 408 when the expandable table 400 is in the unexpanded position. Furthermore, the center edge 416 of each table top section 412 includes a recess 416' on a lower portion thereof adjacent to the projecting member 407 of the second plate member 405 to provide clearance for the fasteners 403 when the table top sections 412 are in the unexpanded position and the projecting members 407 are received in the receiving structures 408. Although the expandable table 400 shown in FIGS. 12-14 includes six table top sections 412, more or less table top sections 412 may be provided as will be apparent to one having ordinary skill in the art. Likewise, although the expandable table 400 shown in FIGS. 12-14 includes six second plate members 405, more or less second plate members 405 may be provided as will be apparent to one having ordinary skill in the art.

Figure 15:
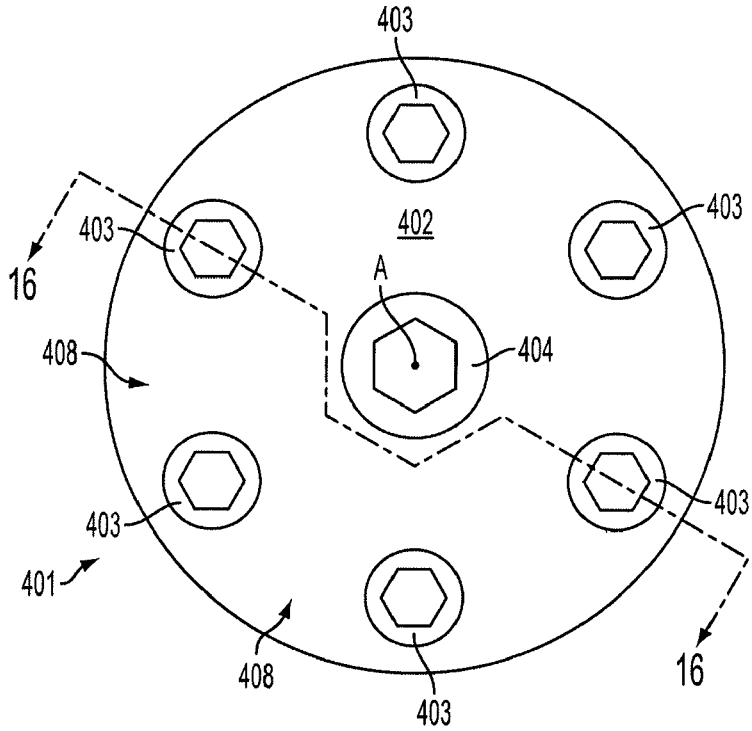
FIG. 15 is a plan view of an example of a first plate member and a plurality of fasteners of the center alignment assembly for the expandable table shown in FIG. 14.

FIG. 15 is an isolated schematic plan view of the first plate member 402 and the plurality of fasteners 403 of the center alignment assembly 401 for the expandable table 400 shown in FIG. 14. In this embodiment, fasteners 403 are positioned on the first plate member 402 radially outwardly of the central axis A and circumferentially spaced from one another to define the receiving structures 408.

Figure 16:
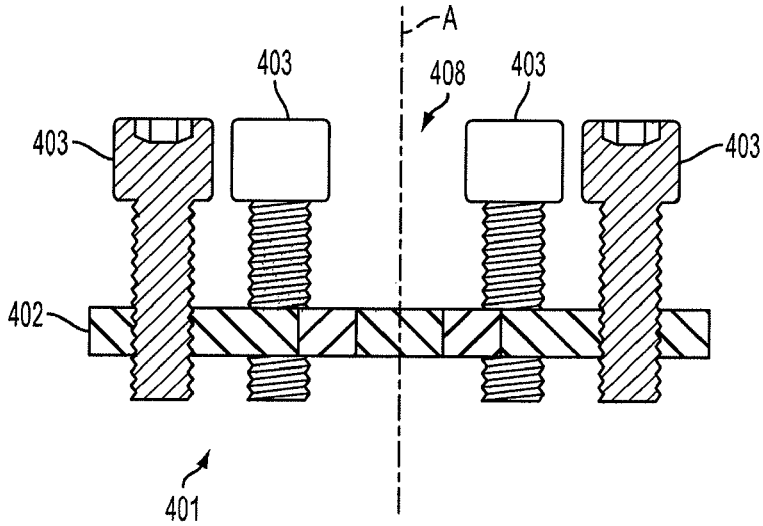
FIG. 16 is a cross-sectional view of the center alignment assembly of FIG. 15 taken along the line 16-16.

FIG. 16 is a cross-sectional view of part of the center alignment assembly 401 of FIG. 15 taken along the line 16-16. In the depicted embodiment, fasteners 403 are shown extending through, and threadedly connected to, the first plate member 402. The fasteners 403 may be attached to the first plate member 402 in other known ways as well, such as, for example, welding or adhesive and, in some embodiments, may not extend through the first plate member 402.

Figure 17:
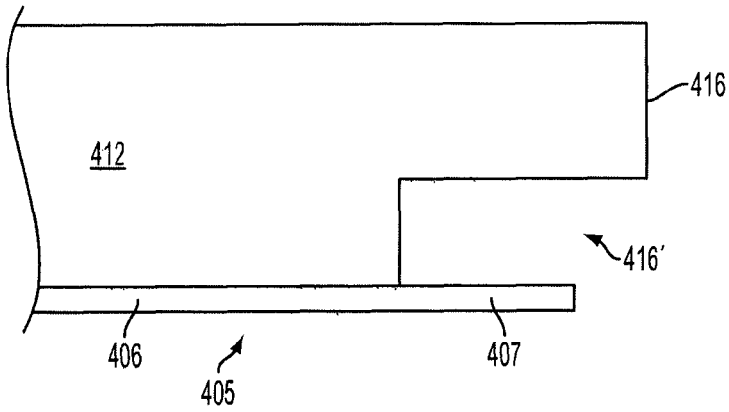
FIG. 17 is a side view of an example of a table top section of the expandable table with one of a plurality of second plate members of the center alignment assembly secured to a bottom surface thereof according to an embodiment of the invention.
Figure 18:
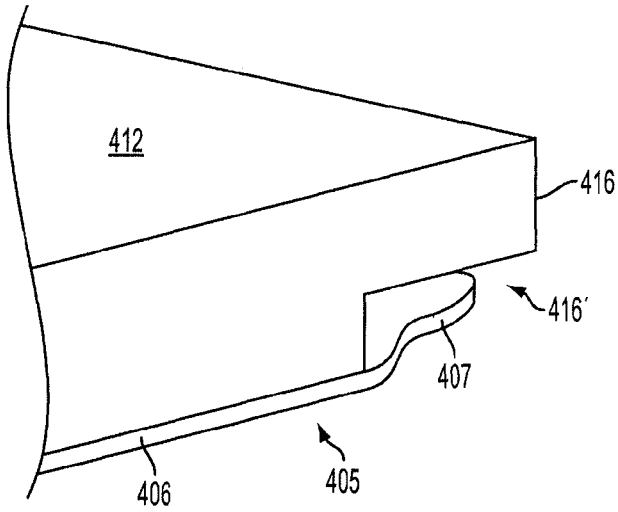
FIG. 18 is a perspective view of the table top section shown in FIG. 17.
Figure 19:
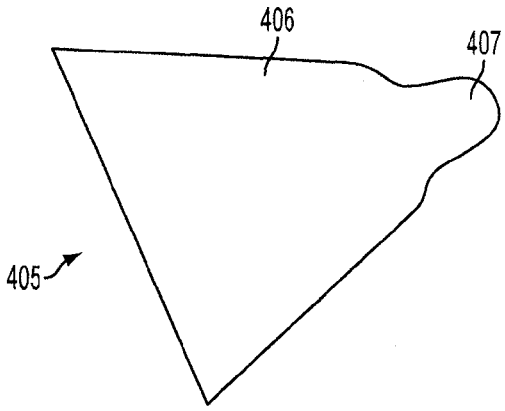
FIG. 19 is a plan view of the second plate member of the center alignment assembly of FIGS. 17 and 18 shown separately from the table top section.
Figure 20:
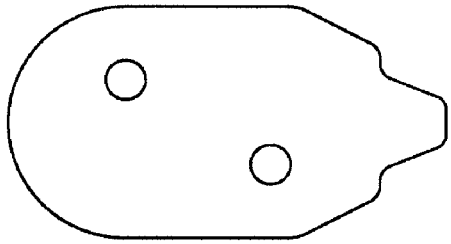
FIGS. 20-23 depict plan views of various alternative embodiments of the second plate member.
Figure 21:
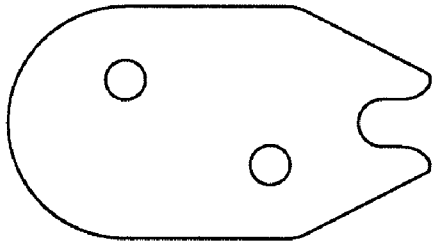
Figure 22:
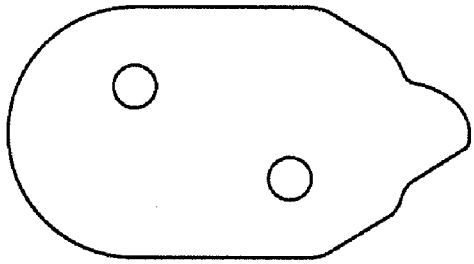
Figure 23:
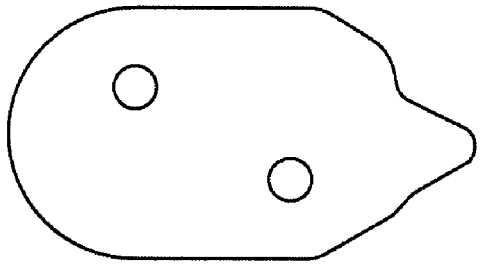

FIG. 17 is a side view of an example of a table top section 412 of the expandable table 400 with one of a plurality of second plate members 405 of the center alignment assembly 401 secured to a bottom surface thereof. The center edge 416 of the table top section 412 includes a cutout on a lower portion thereof defining a recess 416' to allow clearance of the fasteners 403 when the table top sections 412 are in the unexpanded position. The second plate member 405 is shown attached to a bottom surface of the table top section 412, but could be attached at the sides or, alternatively, to one of the walls defining the recess 416'. FIG. 18 is a perspective view of the table top section 412 shown in FIG. 17 and provides a view of the projecting member 407 of the second plate member 405. FIG. 19 is a plan view of the second plate member 405 shown separately from the table top section 412. Although the projecting member 407 shown in FIGS. 18 and 19 is depicted as being a substantially symmetrical tapered projection having rounded transitions, it will be apparent to one having ordinary skill in the art that the projecting member 407 may be of any shape configured to be received in the receiving structures 408 such as, for example, a hook shape or a tapered shaped with sharp transitions. The shape of the projecting member 407 may vary depending on the shape of the table top sections 412 which may ultimately vary the angles at which the projecting members 407 address the receiving structures 408. For example, FIG. 20 shows a second plate member 405*a* according to an alternative embodiment having a substantially symmetrical tapered projecting member 407*a* and being suited for attachment to a table top section having straight sides which taper radially inward to a center edge (see FIG. 1). FIG. 22 shows another embodiment of a second plate member 405*b* having an asymmetrical projecting member 407*b* configured for attachment to a table top section 412 having serpentine (e.g., concave and convex) sides which arcuately taper to center edge 416 (see FIGS. 12-14). Table leaves 66, described above (not shown in FIGS. 12-19), may also have a third plate member (e.g., similar to the above-described second plate members 405, 405*a*, 405*b*) attached thereto and configured to be received by the receiving structures 408 when the expandable table 400 is in the expanded position and the table leaves 66 are inserted between adjacent table top sections 412. FIGS. 22-23 show other embodiments of third plate members 405*c*, 405*d* suited for attachment to different shaped table leaves and having symmetrical and asymmetrical projecting members 407*c*, 407*d* configured based on the angle at which the inner edges of such table leaves will address the receiving structures 408. The second and third plate members 405 and 405*a-d* may be made of any of a number of materials such as, for example, metals or plastics, and, in particular, stamped or machined metal.

In the foregoing description of the examples for some embodiments of the invention, directional words such as "top," "bottom," "upwardly," and "downwardly" are employed by way of description and not limitation with respect to the orientation of the expandable table and the center alignment assembly illustrated in the drawings. Similarly, directional words such as "axial" and "radial" are also employed by way of description and not limitation with respect to the expandable table and the center alignment assembly.

While the invention has been described with respect to certain example embodiments, modifications may be made within the scope of the invention as defined by the appended claims.

What is claimed is:

1. An expandable table defining a central axis, comprising:
- a table support structure;
- a guide plate mounted on the table support structure;
- a plurality of separate table top sections moveably arranged over a top surface of the guide plate between a first closed position and a second expanded position; and
- a center alignment assembly comprising:
  - a first plate member secured to a center portion of the guide plate;
  - a plurality of fasteners attached to the first plate member and spaced from one another at radially outward positions from the central axis, wherein the spaces between adjacent fasteners define a plurality of receiving openings; and
  - a plurality of second plate members, each second plate member secured to one of the plurality of separate table top sections and including a projecting member adapted to be received in one of the receiving openings when the plurality of separate table top sections are in the first closed position.

2. The expandable table of claim 1, wherein the plurality of fasteners are bolts.

3. The expandable table of claim 1, wherein a top surface of the first plate member is arranged substantially flush with the top surface of the guide plate.

4. The expandable table of claim 1, wherein each projecting member is integrally formed on an edge of each of the second plate members and each second plate member is attached to a bottom surface of one of the separate table top sections.

5. The expandable table of claim 1, wherein the table top sections form a substantially contiguous table top when in the first closed position.

6. The expandable table of claim 1, further comprising a plurality of table leaves, each table leaf being constructed and arranged to be removably mounted on the guide plate between respective table top sections when the table top sections are in the second expanded position.

7. The expandable table of claim 6, wherein the table leaves form a substantially contiguous table top with the table top sections when the table top sections are in the second expanded position.

8. The expandable table of claim 6, wherein each table leaf includes a third plate member including a projecting member adapted to be received in one of the receiving openings when the plurality of separate table top sections are in the second expanded position.

9. The expandable table of claim 1, wherein the first plate member is a substantially flat plate of stamped or machined metal.

10. The expandable table of claim 1, wherein the fasteners each include an enlarged head portion and an elongated body portion such that each receiving opening between adjacent fasteners defines a region of restricted vertical and/or horizontal movement for each second plate member received therein.

* * * * *